US007052156B2

(12) United States Patent
Primeau

(10) Patent No.: US 7,052,156 B2
(45) Date of Patent: May 30, 2006

(54) COMBINATION ARTIFICIAL TREE-LIGHTING ARRANGEMENT

(76) Inventor: Sylvain Primeau, 760, de Marseille, St-Amable, Québec J0N 1N0 (CA)

( * ) Notice: Subject to any disclaimer, the term of this patent is extended or adjusted under 35 U.S.C. 154(b) by 326 days.

(21) Appl. No.: 10/701,510

(22) Filed: Nov. 6, 2003

(65) Prior Publication Data

US 2004/0090770 A1 May 13, 2004

(30) Foreign Application Priority Data

Nov. 6, 2002 (GB) ..... 0225808.5

(51) Int. Cl.
*F21S 6/00* (2006.01)
*A47G 33/06* (2006.01)

(52) U.S. Cl. ..... 362/123; 362/234; 362/250; 428/8; 428/20

(58) Field of Classification Search ..... 362/122, 362/123, 234, 249–252, 413, 427, 806; 428/7, 428/8, 18–20
See application file for complete search history.

(56) References Cited

U.S. PATENT DOCUMENTS 1,590,220 A * 6/1926 Wurts ..... 428/20
2,230,900 A * 2/1941 Neitzke ..... 362/123
3,118,617 A * 1/1964 Hellrich ..... 362/123
4,468,421 A * 8/1984 Wang ..... 428/8
5,106,661 A * 4/1992 Pitts, Sr. ..... 428/20
5,150,963 A * 9/1992 Hill ..... 362/123
2002/0097573 A1* 7/2002 Shen ..... 362/123

* cited by examiner

*Primary Examiner*—Alan Cariaso

(57) ABSTRACT

A combination artificial tree-lighting arrangement including a generally elongated tree trunk. The combination also includes a plurality of connecting components mountable on the tree trunk and a plurality of display components mountable on the connecting components. Each display component has tree limbs and lighting cables extending therefrom. The lighting cables are provided with decorative lights. An electrical circuitry connectable to an electrical power source is attachable to the connecting components. The electrical circuitry includes a connecting component-to-light coupling arrangement for electrically coupling the connecting components to the decorative lights. The connecting component-to-light coupling arrangement allows the display components to rotate relative to the connecting components about a rotation axis substantially parallel to the trunk longitudinal axis while maintaining the electrical coupling between the connecting components and the decorative lights.

19 Claims, 6 Drawing Sheets

COMBINATION ARTIFICIAL TREE-LIGHTING ARRANGEMENT

FIELD OF THE INVENTION

The present invention relates to the general field of decoration items and is particularly concerned with a combination artificial tree-lighting arrangement.

BACKGROUND OF THE INVENTION

In recent years, the use of artificial decorative or Christmas trees has become increasingly popular. In addition to being durable, artificial Christmas trees can be made in a variety of styles. The artificial tree can be removed from storage each year during the holiday season, assembled and decorated. At the end of the holidays, the artificial tree is then disassembled and stored until next Christmas.

Some commercially available artificial Christmas trees include a permanent tree trunk and limb assembly with the limbs secured along the trunk at fixed positions. Other forms of artificial Christmas trees include a folding limb arrangement whereby the limbs remain secured to the tree trunk but fold upwardly and inwardly along the trunk for storage purposes.

Most commercially available artificial Christmas trees and associated artificial tree lighting displays suffer from numerous drawbacks. For example, many existing simulated tree light displays have a great number of pieces that must be assembled in a particular manner. If one of the pieces is lost or broken, the display either cannot be properly assembled or, if assembled, does not have adequate structural stability. Additionally the simulated trees and associated lighting displays may be frustrating to assemble as the numerous pieces are difficult to place together.

Furthermore, some artificial Christmas trees and lighting arrangements suffer from lack of versatility and prevent variations in the shape and size of the ornamentation. This often results in the Christmas decorations being placed in the same location and looking the same year after year. Also, some simulated Christmas tree light displays cannot be easily disassembled resulting in the need for a large amount of storage space.

Accordingly, there exists a need for an improved artificial tree and associated lighting display. It is a general object of the present invention to provide such an improved artificial tree and associated lighting display.

In accordance with the present invention, there is provided a combination artificial tree-lighting arrangement, the combination being connectable to an electrical power source for providing an illuminated decoration, the combination comprising: a generally elongated tree trunk, the tree trunk defining a trunk longitudinal axis; at least one connecting component, the connecting component being mountable on the tree trunk; at least one display component mountable on the connecting component, the display component having at least one tree limb extending therefrom, the display component also having at least one lighting cable extending therefrom, the lighting cable being supportable by the tree limb and being provided with at least one decorative light; an electrical circuitry connectable to the electrical power source, the electrical circuitry being attachable to the connecting component, the electrical circuitry including a connecting component-to-light coupling means for electrically coupling the connecting component to the decorative light, the connecting component-to-light coupling means allowing the display component to rotate relative to the connecting component about a rotation axis substantially parallel to the trunk longitudinal axis while maintaining the electrical coupling between the connecting component and the decorative light.

Typically, the connecting component is provided with a connecting component-to-trunk attachment means for allowing attachment of the connecting component at various locations along the trunk longitudinal axis.

Conveniently, the combination comprises two connecting components and two corresponding display components, the electrical circuitry further including connecting component-to-connecting component electrical coupling means for electrically coupling the two connecting components.

Typically, at least one of the connecting components is provided with a connecting component-to-trunk attachment means for allowing attachment of the connecting component at various locations along the trunk longitudinal axis, the connecting component-to-trunk attachment means allowing adjustment of the spacing between the connecting components, the connecting component-to-connecting component electrical coupling means maintaining the electrical coupling between the coupling components within a predetermined spacing range between the connecting components.

Conveniently, the tree limb is pivotable relative to the display component between a limb extended configuration and a limb retracted configuration wherein the tree limb forms an angle having respectively a larger and a smaller value relative to the trunk longitudinal axis.

Typically, the lighting cable is releasably attachable to the display component. Conveniently, the display component has two tree limbs extending therefrom, the display component also having two corresponding lighting cables extending therefrom, each of the lighting cables being supportable by a corresponding tree limb and being provided with at least one decorative light; wherein the lighting cables are interchangeable.

Typically, the combination further comprises two connecting components and two corresponding display components, the electrical circuitry further including connecting component-to-connecting component electrical coupling means for electrically the two connecting components; at least one of the connecting components being provided with a connecting component-to-trunk attachment means for allowing attachment of the connecting component at various locations along the trunk longitudinal axis, the connecting component-to-trunk attachment means allowing adjustment of the spacing between the connecting components, the connecting component-to-connecting component electrical coupling means maintaining the electrical coupling between the coupling components within a predetermined spacing range between the connecting component; at least one of the display components having two tree limbs extending therefrom, the at least one of the display components also having two corresponding lighting cables extending therefrom, each of the lighting cables being supportable by a corresponding tree limb; the lighting cables being releasably attachable and interchangeable.

Conveniently, the connecting component includes a substantially cylindrical connecting wall, the connecting wall being configured and sized for being slidably and substantially fittingly insertable over a corresponding longitudinal section of the tree trunk; the connecting component also including a connecting flange extending outwardly and substantially radially from the connecting wall substantially adjacent a lower peripheral edge thereof; the display component including a substantially cylindrical display wall, the display wall being configured and sized for being slidably and substantially fittingly insertable over at least a portion of the connecting wall, the display wall being also configured and sized for allowing a lower peripheral edge thereof to abuttingly rest on the connecting flange.

Typically, the display component is also provided with a display arm extending outwardly and substantially radially from the outer surface of the display wall; the display arm being provided with a limb attachment means for attaching the tree limb and a lighting cable coupling means for electrically coupling and attaching the lighting cable.

Conveniently, the tree limb is pivotable relative to the display component between a limb extended configuration and a limb retracted configuration wherein the tree limb forms an angle having respectively a larger and a smaller value relative to the trunk longitudinal axis; the limb attachment means including a substantially cylindrical limb base attached to a proximal end of the tree limb; the limb attachment means also including a limb receiving recess formed in the display arm, the limb receiving recess defining a base receiving section configured and sized for substantially fittingly and pivotally receiving the limb base and a limb abutment section extending from the base receiving section for abuttingly limiting the pivotal movement of the limb between the limb extended and retracted configurations.

Typically, the lighting cable coupling means includes a cable plug attached to a proximal end of the lighting cable, the cable plug having a plug body and a pair of plug prongs extending from the plug body, the plug prongs being electrically coupled to the lighting cable; the lighting cable coupling means also including a plug receiving recess formed is the display arm for receiving the plug body and a pair of prong sockets formed in the plug receiving recess for receiving the plug prongs and allowing electrical coupling between the plug prongs and the prong sockets, the prong sockets being electrically coupled to a corresponding pair of arm wires extending at least partially through the display arm.

Conveniently, the lighting cable coupling means includes a pair of coupling strips extending substantially circumferentially from the limb base, the coupling strips being electrically coupled to a proximal end of the lighting cable; the lighting cable coupling means also including a pair of strip contacting components for contacting the coupling strips and allowing electrical coupling between the coupling strips and the strip contacting components, the strip contacting components protruding from a contacting component receiving recess formed in the display arm; the strip contacting components being electrically coupled to a corresponding pair of arm wires extending at least partially through the display arm.

Typically, the connecting component-to-light coupling means includes a first and a second connecting component coupling ring, the connecting component first and second coupling rings being mounted on the connecting component and being electrically connectable to the electrical power source, the connecting component-to-light coupling means includes a first and a second display component coupling ring, the display component first and second coupling rings being mounted on the display component and connectable to the lighting cable, the first and second connecting component coupling rings and the first and second display component coupling rings being configured, positioned and sized for allowing electrical coupling respectively therebetween so as to allow electrical coupling of the lighting cable to the electrical power source when the display component is operatively mounted on the connecting component.

Conveniently, the first and second connecting component coupling rings are positioned respectively on an outer surface of the connecting wall and on an upper surface of the connecting flange and wherein the first and second display component coupling rings are positioned respectively on an inner surface of the display wall and on a lower peripheral edge of the display wall.

Typically, the combination comprises two connecting components and two corresponding display components, the electrical circuitry further including connecting component-to-connecting component electrical coupling means for electrically the two connecting components; the first and second connecting component coupling rings being electrically coupled to both to a connecting component male plug and a connecting component female plug respectively by a first ring-to-male plug cable and a second ring-to-male plug cable and by a first ring-to-female plug cable and a second ring-to-female plug cable; the connecting component-to-connecting component electrical coupling means including a connecting component-to-connecting component cable for electrically coupling the connecting component male and female plugs of adjacent connecting components.

Conveniently, the display component has two tree limbs extending therefrom, the display component also having two corresponding lighting cables extending therefrom, each of the lighting cables being supportable by a corresponding tree limb and being provided with at least one decorative light; the lighting cables being electrically coupled in serie to the electrical power source.

Typically, the display component has two tree limbs extending therefrom, the display component also having two corresponding lighting cables extending therefrom, each of the lighting cables being supportable by a corresponding tree limb and being provided with at least one decorative light; the lighting cables being electrically coupled in parallel to the electrical power source.

In accordance with the present invention, there is also provided a combination artificial tree-lighting arrangement, the combination being connectable to an electrical power source for providing an illuminated decoration, the combination comprising: a generally elongated tree trunk, the tree trunk defining a trunk longitudinal axis; at least one connecting component, the connecting component being mountable on the tree trunk; at least one display component mountable on the connecting component, the display component having at least one tree limb extending therefrom, the display component also having at least one lighting cable extending therefrom, the lighting cable being supportable by the tree limb and being provided with at least one decorative light; an electrical circuitry connectable to the electrical power source, the electrical circuitry being attachable to the connecting component, the electrical circuitry including a connecting component-to-light coupling means for electrically coupling the connecting component to the decorative light, the connecting component-to-light coupling means allowing the display component to rotate relative to the connecting component about a rotation axis substantially parallel to the trunk longitudinal axis while maintaining the electrical coupling between the connecting component and the decorative light; the lighting cable being releasably attachable to the display component.

Advantages of the present invention include that the proposed artificial Christmas tree and associated light display is designed so as to provide an aesthetically pleasing visual appearance. Also, the proposed structure allows for variations in the visual effect produced by the branches and associated lighting display.

Furthermore, the proposed structure facilitates assembly and disassembly of the artificial Christmas tree and associated light structure through a set of quick and ergonomic steps without requiring special tooling or manual dexterity. Still furthermore, the proposed structure allows the Christmas tree and associated lighting display to be folded in a generally compact configuration when not in use so as to reduce the storage space.

Still furthermore, the proposed structure is designed so as to be manufacturable using conventional forms of manufacturing so as to provide a structure that will be economically feasible, long lasting and relatively trouble free in operation.

BRIEF DESCRIPTION OF THE DRAWINGS

Various embodiments of the present invention will now be disclosed, by way of example, in reference to the following drawings in which.

DETAILED DESCRIPTION

Figure 1:
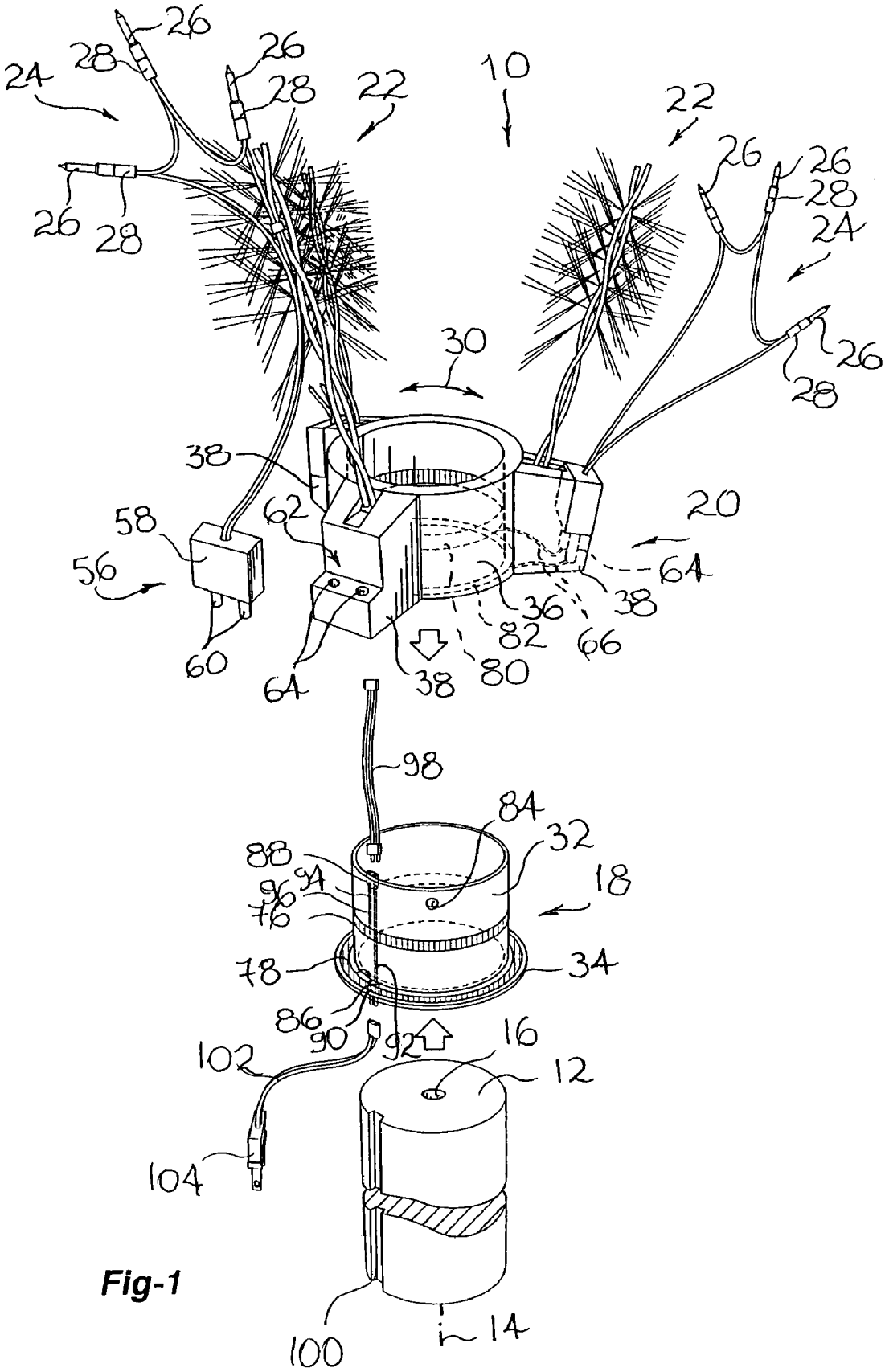
FIG. 1: in a partial exploded view with sections taken out, illustrates part of a combination artificial tree-lighting arrangement in accordance with an embodiment of the present invention.
Figure 2:
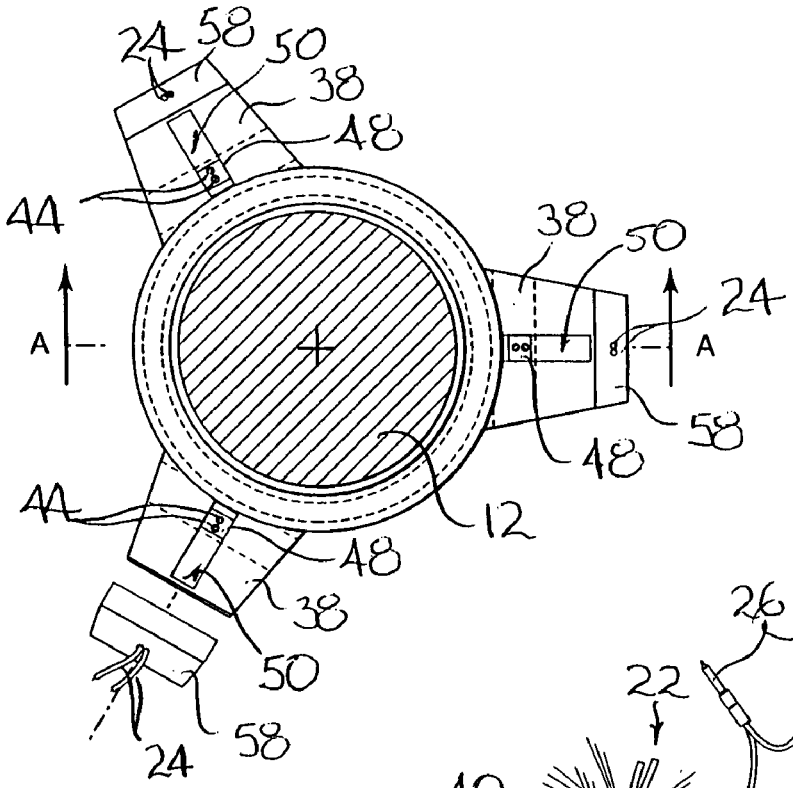
FIG. 2: in a transversal cross-sectional view, illustrates part of the combination shown in FIG. 1.

Referring to FIG. 1, there is shown part of a combination artificial tree-lighting arrangement generally indicated by the reference numeral 10. The combination 10 is connectable to a conventional electrical power source for providing an illuminated decoration. Although the embodiment shown in FIG. 1 illustrates the combination being connectable to a conventional female-type electrical socket, it should be understood that the combination 10 could be connectable to other sources of electrical power such as a battery, or the like, without departing from the scope of the present invention.

The combination 10 includes a generally elongated tree trunk 12 (only a longitudinal section thereof is shown throughout the figures). The tree trunk 12 defines a trunk longitudinal axis 14. The tree trunk 12 typically has a substantially disc-shaped cross-sectional configuration, although the tree trunk 12 could have other configurations without departing from the scope of the present invention.

Also, the tree trunk 12 is shown throughout the figures as having a substantially central trunk channel 16 extending longitudinally therethrough. The trunk channel 16 is adapted to be used for allowing insertion therein of a lighting cable, or other ornamental feature. It should however be understood that the tree trunk 12 could be deprived of the trunk channel 16 without departing from the scope of the present invention.

The combination 10 also includes at least one, and typically a plurality of connecting components 18. Each connecting component 18 is mountable on the tree trunk 12. Typically, each connecting component 18 is provided with a corresponding connecting component-to-trunk attachment means for allowing attachment thereof at various locations along the trunk longitudinal axis 14. Typically, numerous connecting components 18 are positioned along the tree trunk 12.

The combination 10 further includes at least one, and typically a plurality of display components 20. Each display component 20 is mountable on a corresponding connecting component 18. Each display component 20 has at least one, and typically a plurality, of tree limbs 22 extending therefrom. Each display component 20 also has at least one, and typically a plurality, of lighting cables 24 extending therefrom.

Typically, each lighting cable 24 is supportable by a corresponding adjacent tree limb 22. Also, each lighting cable 24 is typically provided with at least one, and typically a plurality, of decorative lights 26. In the embodiments shown throughout the figures, the decorative lights 26 include miniature-type bulbs coupled to corresponding miniature-type sockets 28. It should however be understood that other types of decorative lights could be used without departing from the scope of the present invention.

The combination 10 still further includes an electrical circuitry connectable to the electrical power source. The electrical circuitry is attachable to the connecting components 18. The electrical circuitry includes a connecting component-to-light coupling means for electrically coupling the connecting components 18 to corresponding decorative lights 26. In situations wherein the combination 10 includes two or more connecting components 18 and two or more display components 20, the electrical circuitry further includes a connecting component-to-connecting component electrical coupling means for electrically coupling adjacent connecting components 18.

Typically, the connecting component-to-light coupling means allows at least one, and typically all display components 20 to rotate relative to a corresponding connecting component 18 about a rotation axis substantially parallel to the trunk longitudinal axis 14 while maintaining the electrical coupling between the connecting component 18 and the corresponding decorative lights 26. Rotation of the display components 20 relative to the connecting components 18 is represented schematically in FIG. 1 by arrows 30.

Each lighting cable 24 is typically releasably attachable to a corresponding display component 20. In situations wherein a display component 20 has two or more tree limbs 22 extending therefrom and two or more lighting cables 24 also extending therefrom, each of the lighting cables 24 is typically supportable by a corresponding tree limb 22. Also, the lighting cables 24 are typically interchangeable.

Each connecting component 18 typically includes a substantially cylindrical connecting wall 32. The connecting wall 32 is configured and sized for being slidably and substantially fittingly insertable over a corresponding longitudinal section of the tree trunk 12. Each connecting component 18 typically also includes a connecting flange 34 extending outwardly and substantially radially from a corresponding connecting wall 32 substantially adjacent to a lower peripheral edge thereof.

Each display component 20 typically includes a substantially cylindrical display wall 36. The display wall 36 is configured and sized for being slidably and substantially fittingly insertable over at least a portion of a corresponding connecting wall 32. The display wall 36 is also configured and sized for allowing a lower peripheral edge thereof to abuttingly rest on a corresponding connecting flange 34.

Figure 5:
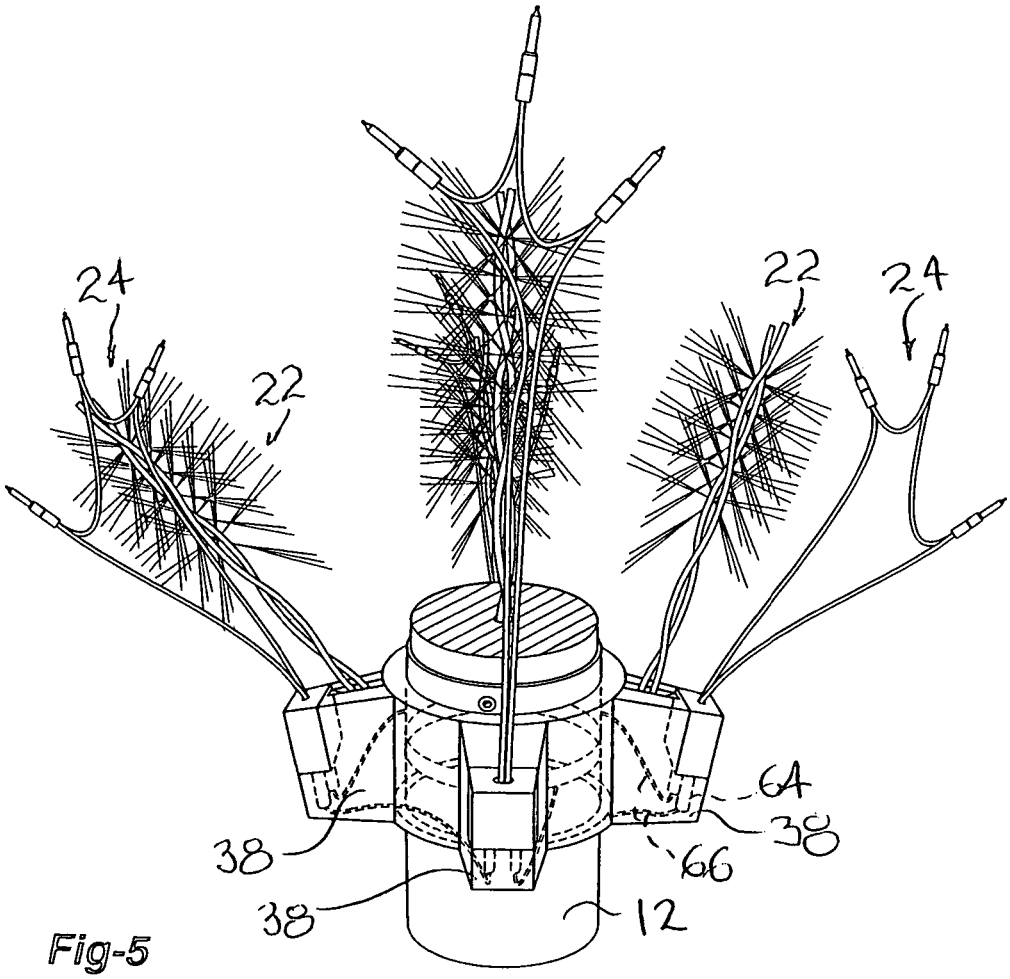
FIG. 5: in a partial perspective view with sections taken out, illustrates part of the higher section of a combination artificial tree-lighting arrangement in accordance with an embodiment of the present invention.
Figure 6:
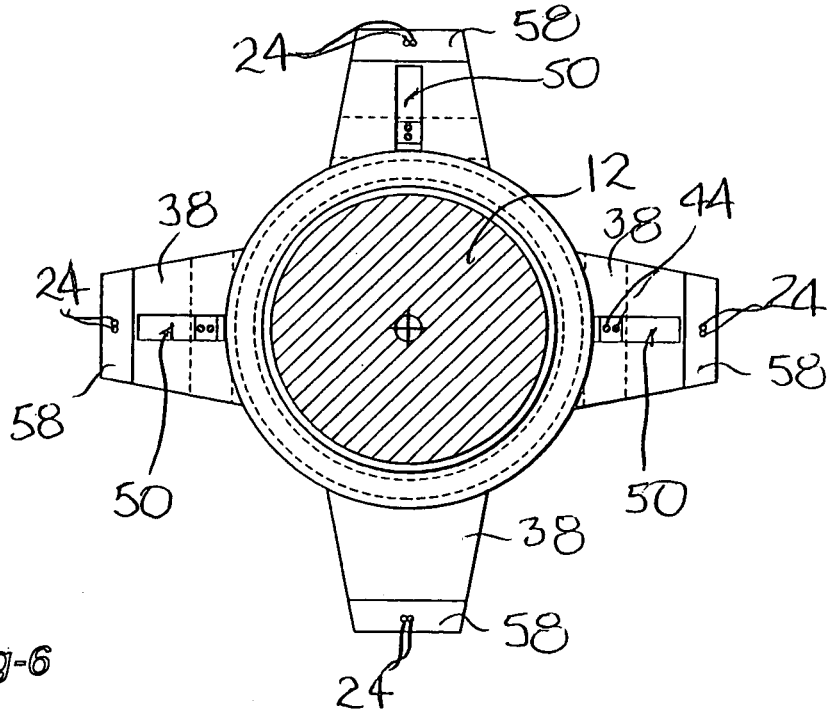
FIG. 6: in a transversal cross-sectional view, illustrates some of the features of the combination shown in FIG. 5.

Each display component 20 is further provided with at least one, and typically three or more display arms 38 extending outwardly and substantially radially from the outer surface of a corresponding display wall 36. In FIGS. 1 through 4, 7, 9 and 10, the display component 20 is shown as having three equally spaced display arms 38 while in FIGS. 5, 6 and 8 the display component is shown as having four equally spaced display arms 38. It should however be understood that each display component 20 could be provided with any suitable number of display arms 38 positioned in any suitable configuration relative to each other without departing from the scope of the present invention.

Each display arm 38 is typically provided with a limb attachment means for attaching a corresponding tree limb 22 and a lighting coupling means for electrically coupling and attaching a corresponding lighting cable 24. Typically, each tree limb 22 is pivotable relative to a corresponding display component 20 between a limb extended configuration and a limb retracted configuration wherein the tree limb 22 forms an angle having respectively a larger and a smaller value relative to the trunk longitudinal axis 14. The pivotal movement of a tree limb 22 towards the retracted and extended configurations is illustrated schematically by arrows 40 and 42 respectively in FIG. 3.

Throughout the figures, each tree limb 22 is shown including a pair of metallic or polymeric wires 44 twisted together and having a plurality of simulated evergreen needles 46 extending outwardly therefrom. It should however be understood that the tree limbs 22 could be otherwise formed or manufactured without departing from the scope of the present invention.

Figure 3:
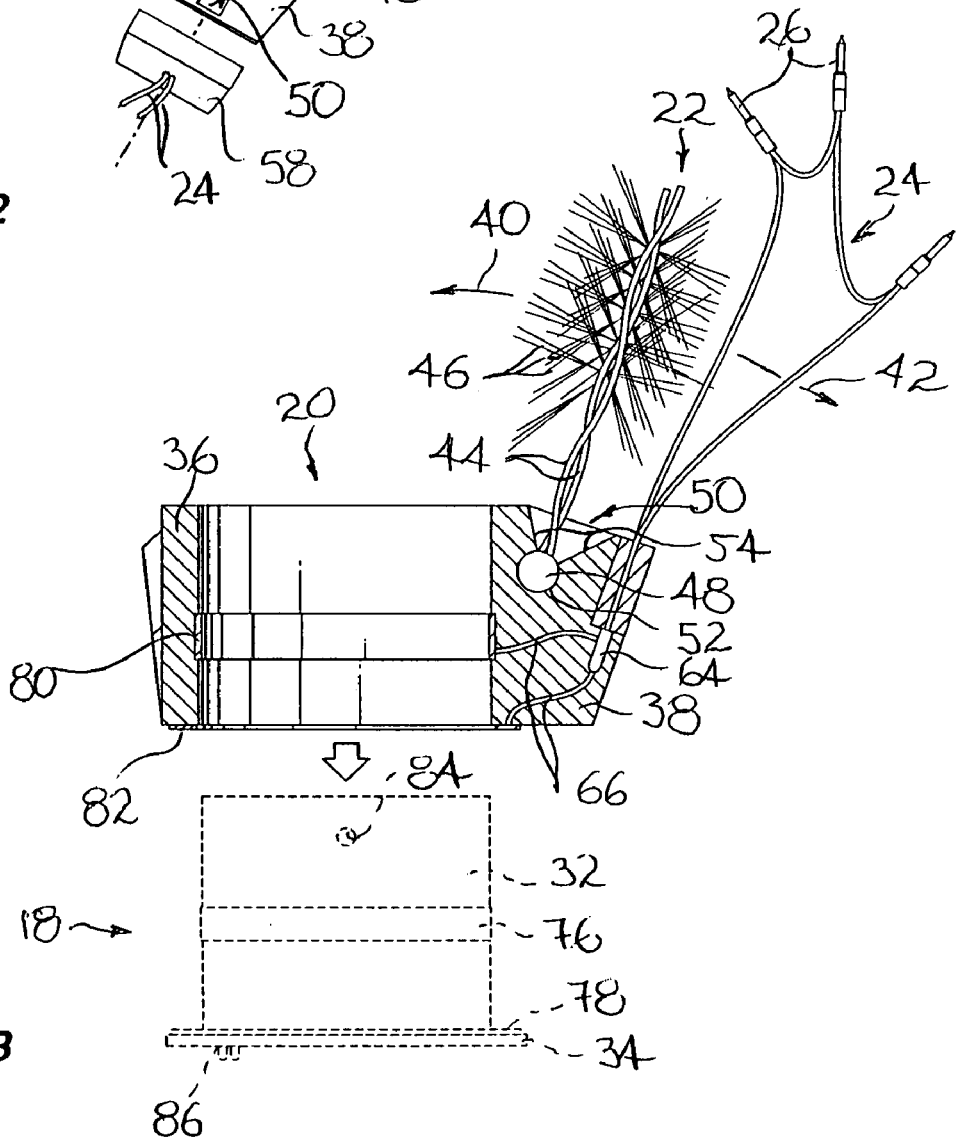
FIG. 3: in a longitudinal cross-sectional view taken along arrows A—A of FIG. 2, illustrates some of the internal features of the components shown in FIG. 2.
Figure 4:
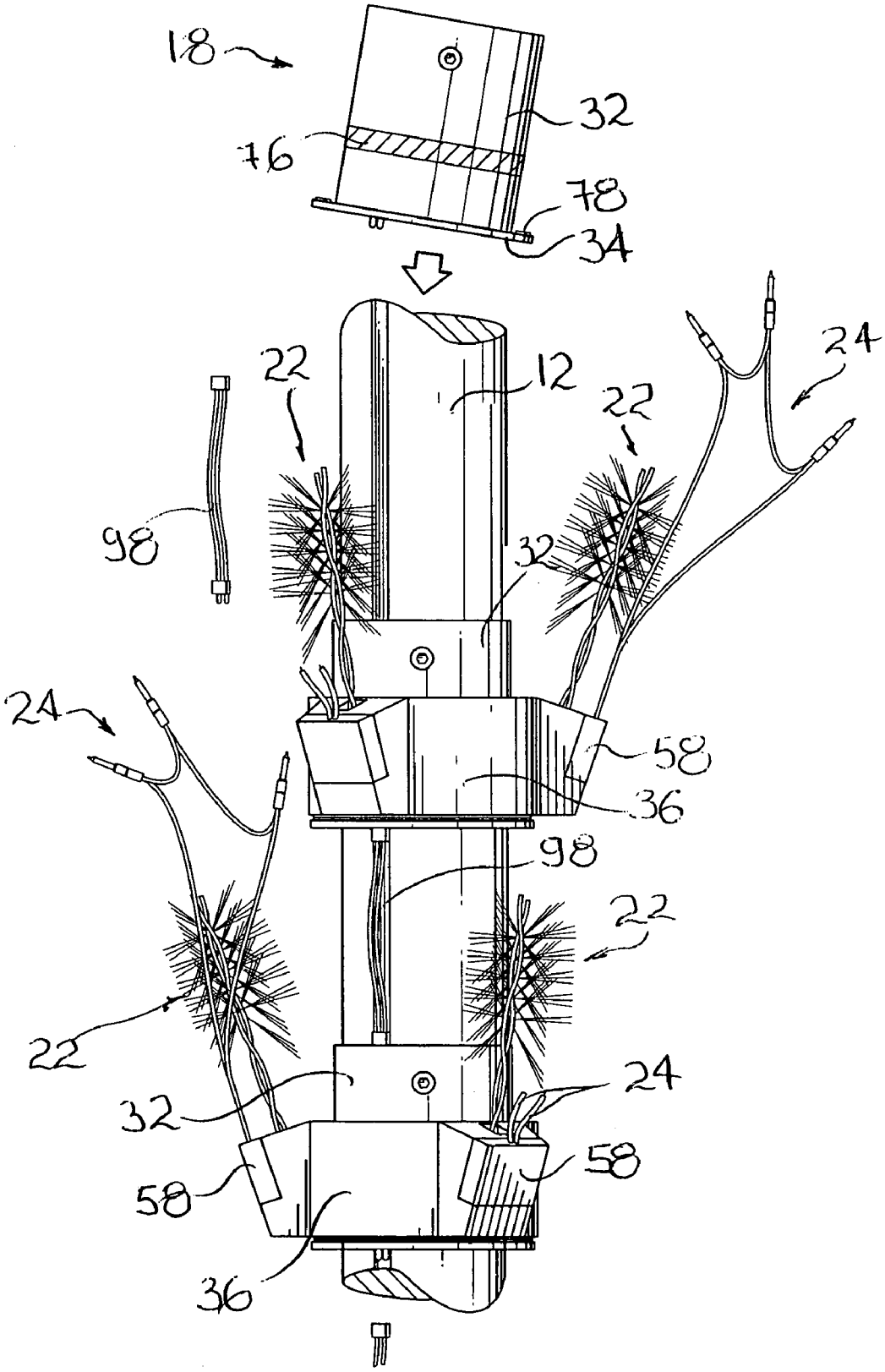
FIG. 4: in a partial elevational view with sections taken out, illustrates part of a combination artificial tree-lighting arrangement in accordance with an embodiment of the present invention.
Figure 9:
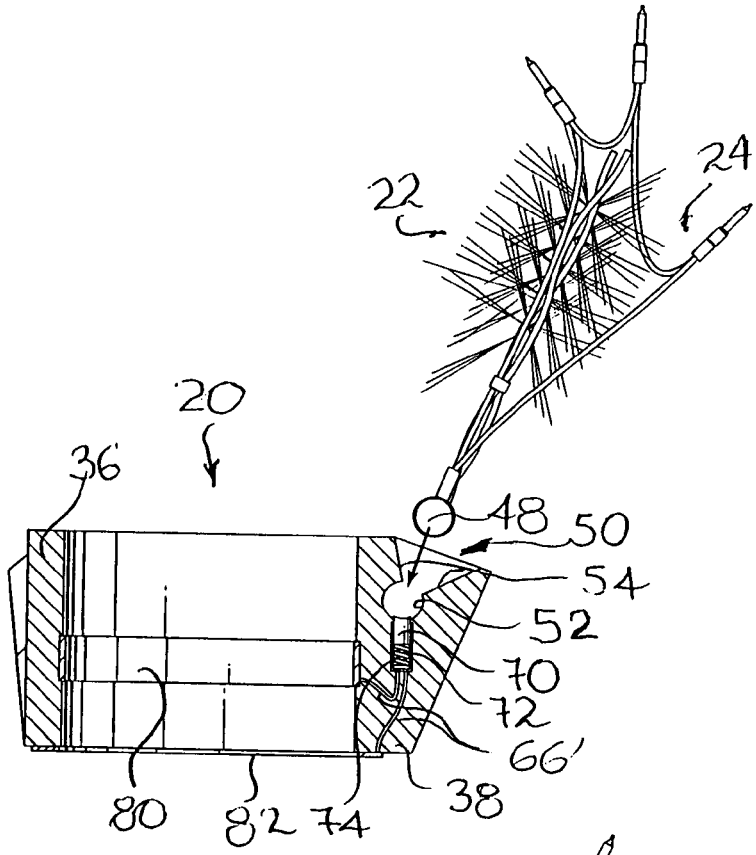
FIG. 9: in a partial longitudinal cross-sectional view, illustrates some of the features of a combination artificial tree-lighting arrangement in accordance with an alternative embodiment of the present invention.
Figure 10:
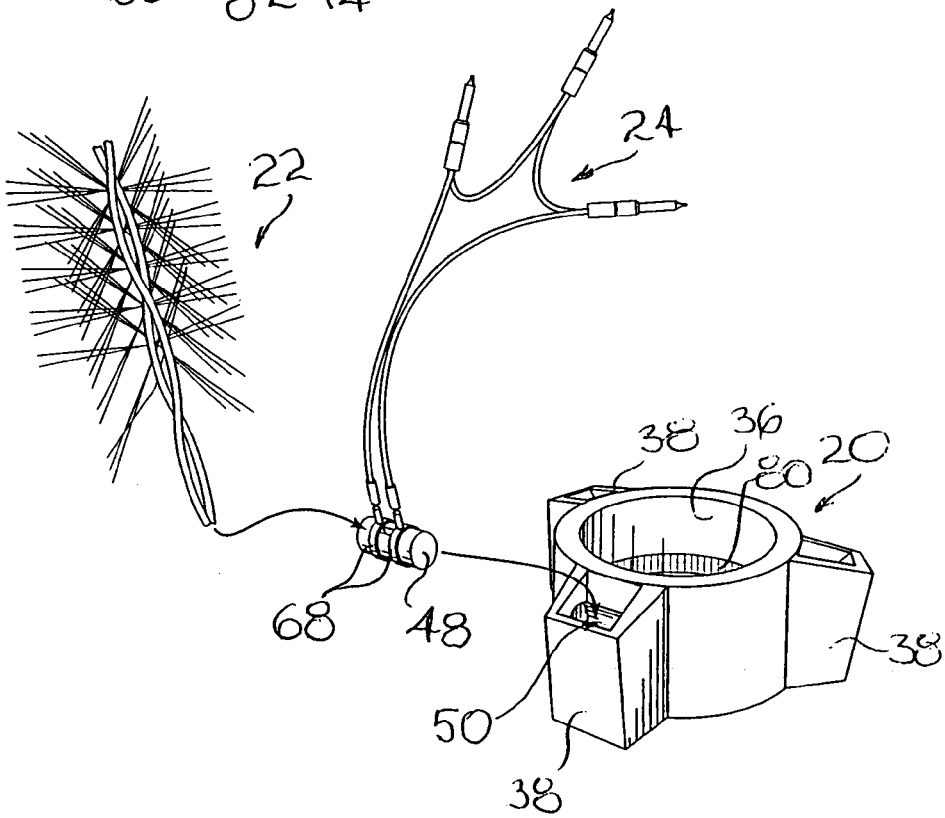
FIG. 10: in a partial exploded view with sections taken out, illustrates some of the features of the combinations shown in FIG. 9.

As illustrated more specifically in FIGS. 3, 9 and 10, the limb attachment means typically includes a substantially cylindrical limb base 48 attached to a proximal end of a corresponding tree limb 22. The limb attachment means also includes a limb recess 50 formed in the corresponding display arm 38.

The limb receiving recess 50 defines a base receiving section 52 configured and sized for substantially fittingly and pivotally receiving a corresponding limb base 48. The limb receiving recess 50 also defines a limb abutment section extending from the base receiving section 52 for abuttingly limiting the pivotal movement of the corresponding limb 22 between the limb extended and retracted configurations. Typically, each limb abutment section includes a pair of abutment walls 54 converging inwardly towards the base receiving section 52.

In the embodiments of the invention shown in FIGS. 1 through 8, the lighting cable coupling means includes a cable plug 56 attached to a proximal end of the lighting cable 24. Each cable plug 56 has a corresponding plug body 58 and a pair of corresponding plug prongs 60 extending from the plug body 58. The plug prongs 60 are electrically coupled to the lighting cable 24 in a conventional manner.

In the embodiments shown in FIGS. 1 through 8, the lighting cable coupling means also includes a plug receiving recess 62 formed in each display arm 38 for receiving a corresponding plug body 58 and a pair of prong sockets 64 formed in each plug receiving recess 62 for receiving corresponding plug prongs 60 and allowing electrical coupling between the plug prongs 60 and the prong sockets 64. As illustrated in FIG. 3, the prong sockets 64 are electrically coupled to a corresponding pair of arm wires 66 extending at least partially through a corresponding display arm 38.

In another embodiment of the invention shown in FIGS. 9 and 10, the lighting cable coupling means includes a pair of coupling strips 68 extending substantially circumferentially from the limb base 48. The coupling strips 68 are electrically coupled to a proximal end to a corresponding lighting cable 24.

In the embodiments shown in FIGS. 9 and 10, the lighting cable coupling means also includes a pair of strip contacting components 70 for contacting the coupling strips 68 and allowing electrical coupling between the coupling strips 68 and the strip contacting components 70. The strip contacting components 70 protrude from a corresponding contacting component receiving recess 72 formed in each display arm 38. The strip contacting components 70 are electrically coupled to a corresponding pair of arm wires 66' extending at least partially through the display arm 38.

Typically, the strip contacting components 70 are resiliently biased by a biasing component so that a tip portion thereof resiliently protrudes from the contacting component receiving recesses 72. The biasing component may take any suitable form such as that of a helicoidal-type spring 74 positioned between a base portion of the strip contacting components 70 and a corresponding base portion of the contacting component receiving recess 72. It should be understood that other types of biasing means may be used without departing from the scope of the present invention.

The connecting component-to-light coupling means includes a first and a second connecting component coupling ring 76, 78. The connecting component first and second coupling rings 76, 78 are mounted on the connecting component 18 and are electrically connectable to the electrical power source.

The connecting component-to-light coupling means also includes a first and a second display component coupling ring 80, 82. The display component first and second coupling rings 80, 82 are mounted on the display component 20 and are connectable to the lighting cables 24. The first and second connecting components coupling rings 76, 78 and the first and second display component coupling rings 80, 82 are configured, positioned and sized for allowing electrical coupling respectively therebetween so as to allow electrical coupling of the lighting cables 24 to the electrical power source when the corresponding display component 20 is operatively mounted on a corresponding connecting component 18.

The first and second connecting component coupling rings 76, 78 and the first and second display component coupling rings 80, 82 are typically made out of a strip of substantially electrically conductive material such as a strip of metallic alloy, or the like.

The first and second connecting component coupling rings 76, 78 are typically positioned respectively on an outer surface of the connecting wall 32 and on an upper surface of the connecting flange 34. The first and second display component coupling rings 80, 82 are typically positioned respectively on an inner surface of the display wall 36 and on a lower peripheral edge of the display wall 36. It should however be understood that the connecting and display component first and second coupling rings 76 through 82 could be positioned at other locations without departing from the scope of the present invention.

Typically, each connecting component 18 is provided with a corresponding connecting component-to-trunk attachments means for allowing attachment of the corresponding connecting component 18 at various locations along the trunk longitudinal axis 14. In the embodiments shown throughout the figures, the connecting component-to-trunk attachment means includes an attachment aperture 84 formed in the attachment wall 32. The attachment aperture 84 is adapted to receive a conventional attachment component such as a bolt for frictionally engaging the outer surface of the tree trunk 12. The connecting component-to-trunk attachment means allows adjustment of the spacing between adjacent connecting components 18. The connecting component-to-connecting component electrical coupling means maintains the electrical coupling between the coupling components 18 when the latter are spaced apart within a predetermined spacing range.

The first and second connecting component coupling rings 76, 78 are electrically coupled to both a connecting component male plug 86 and a connecting component female plug 88 respectively by a first ring-to-male plug cable 90, a second ring-to-male plug cable 92, a first ring-to-female plug cable 94 and a second ring-to-female plug cable 96. The connecting component-to-connecting component electrical coupling means includes a connecting component-to-connecting component cable 98 for electrically coupling the connecting component male and female plugs 86, 88 of adjacent connecting components 18.

The tree trunk 12 is preferably provided with a trunk longitudinal groove 100 extending therealong. The trunk longitudinal groove 100 is configured and sized for receiving the connecting component-to-connecting component cables 98.

Typically, the lowermost connecting component 18 is electrically coupled to a conventional female-type electrical outlet using a main connecting cable 102 having a conventional male plug 104 at a proximal end thereof.

Figure 7:
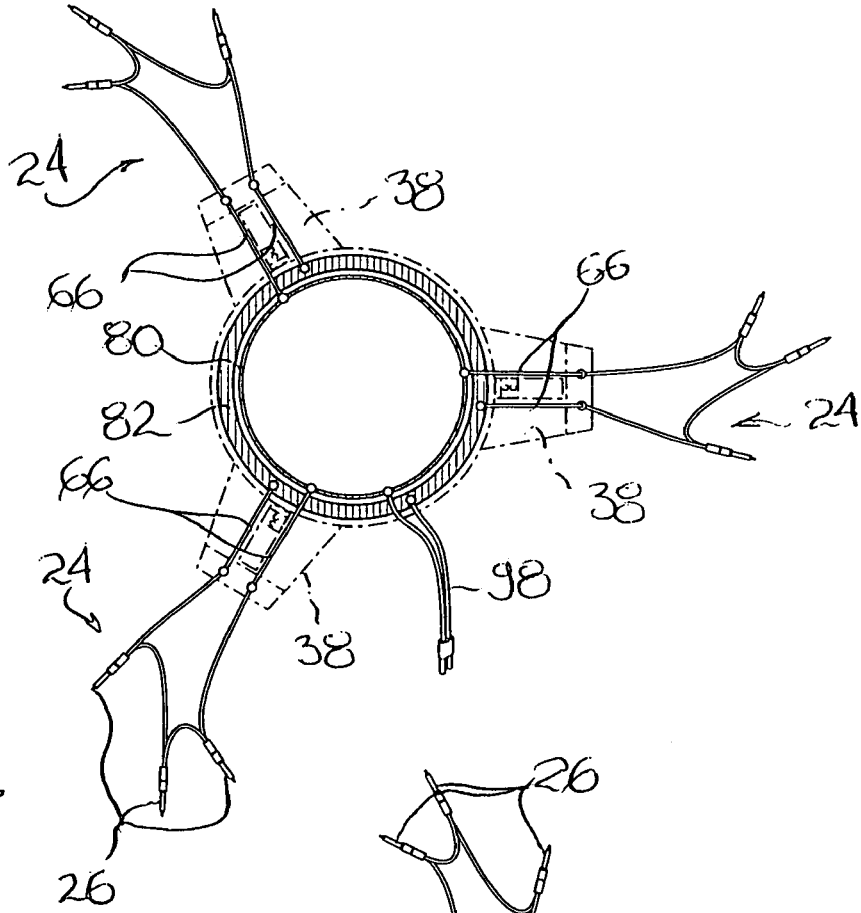
FIG. 7: in a schematic view with sections taken out, illustrates some of the electric circuitry associated with the embodiments shown in FIGS. 1 through 4.
Figure 8:
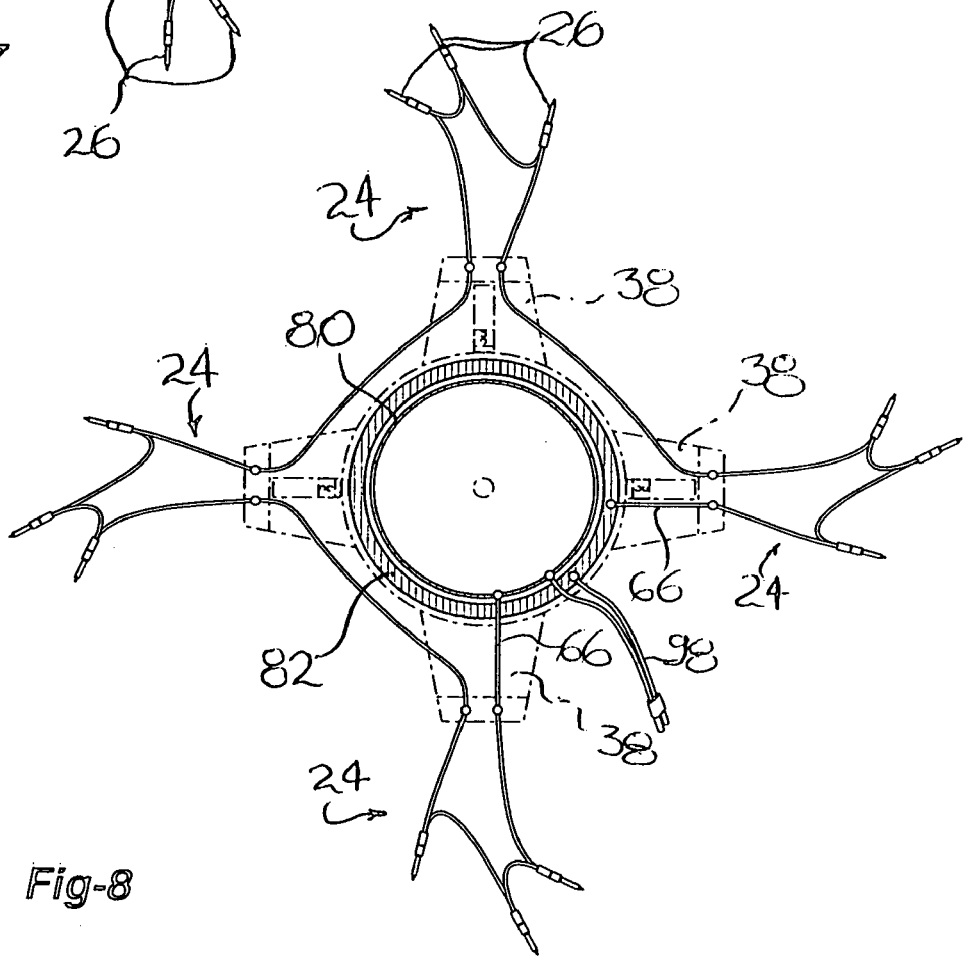
FIG. 8: in a schematic view with sections taken, out illustrates part of the circuitry associated with the embodiment shown in FIGS. 5 and 6.

As illustrated in FIGS. 7 and 8, the lighting cables 24 may be electrically coupled respectively in serie or in parallel to the electrical power source. Typically, the lighting cables 24 associated with the lower connecting components 18 are connected in parallel as shown in FIG. 7 while the lighting cables 24 associated with the higher located connecting components 18 are connected in serie, as shown in FIG. 8.

In use, each connecting component 18 and associated display component 20 may be positioned at a suitable position along the tree trunk 12. Once in place, the display components 20 may be rotated about a rotating axis parallel to the trunk longitudinal axis 14 and/or the lighting cables 24 may be interchanged and/or the limbs 22 may be pivoted to provide a variety of different limb and lighting configurations.

When not in use, the connecting and display components 18, 20 may be removed from the tree trunk 12 and the limbs 22 may be pivoted towards their retracted configuration and removed from their corresponding display arms through a set of quick and ergonomic steps to facilitate in the storage of the combination 10.

The embodiments of the invention in which an exclusive privilege or property is claimed are defined as follows:

1. A combination artificial tree-lighting arrangement, said combination being connectable to an electrical power source for providing an illuminated decoration, said combination comprising:

a generally elongated tree trunk, said tree trunk defining a trunk longitudinal axis;

at least one connecting component, said connecting component being mountable on said tree trunk;

at least one display component mountable on said connecting component, said display component having at least one tree limb extending therefrom, said display component also having at least one lighting cable extending therefrom, said lighting cable being supportable by said tree limb and being provided with at least one decorative light;

an electrical circuitry connectable to said electrical power source, said electrical circuitry being attachable to said connecting component, said electrical circuitry including a connecting component-to-light coupling means for electrically coupling said connecting component to said decorative light, said connecting component-to-light coupling means allowing said display component to rotate relative to said connecting component about a rotation axis substantially parallel to said trunk longitudinal axis while maintaining the electrical coupling between said connecting component and said decorative light.

2. A combination as recited in claim 1 wherein said connecting component is provided with a connecting component-to-trunk attachment means for allowing attachment of said connecting component at various locations along said trunk longitudinal axis.

3. A combination as recited in claim 1 comprising two connecting components and two corresponding display components, said electrical circuitry further including connecting component-to-connecting component electrical coupling means for electrically coupling said two connecting components.

4. A combination as recited in claim 3 wherein at least one of said connecting components is provided with a connecting component-to-trunk attachment means for allowing attachment of said connecting component at various locations along said trunk longitudinal axis, said connecting component-to-trunk attachment means allowing adjustment of the spacing between said connecting components, said connecting component-to-connecting component electrical coupling means maintaining the electrical coupling between said coupling components within a predetermined spacing range between said connecting components.

5. A combination as recited in claim 1 wherein said tree limb is pivotable relative to said display component between a limb extended configuration and a limb retracted configuration wherein said tree limb forms an angle having respectively a larger and a smaller value relative to said trunk longitudinal axis.

6. A combination as recited in claim 1 wherein said lighting cable is releasably attachable to said display component.

7. A combination as recited in claim 1 wherein said display component has two tree limbs extending therefrom, said display component also having two corresponding lighting cables extending therefrom, each of said lighting cables being supportable by a corresponding tree limb and being provided with at least one decorative light; wherein said lighting cables are intercheangable.

8. A combination as recited in claim 1 comprising two connecting components and two corresponding display components, said electrical circuitry further including connecting component-to-connecting component electrical coupling means for electrically said two connecting components; at least one of said connecting components being provided with a connecting component-to-trunk attachment means for allowing attachment of said connecting component at various locations along said trunk longitudinal axis, said connecting component-to-trunk attachment means allowing adjustment of the spacing between said connecting components, said connecting component-to-connecting component electrical coupling means maintaining the electrical coupling between said coupling components within a predetermined spacing range between said connecting component; at least one of said display components having two tree limbs extending therefrom, said at least one of said display components also having two corresponding lighting cables extending therefrom, each of said lighting cables being supportable by a corresponding tree limb; said lighting cables being releasably attachable and interchangeable.

9. A combination as recited in claim 1 wherein said connecting component includes a substantially cylindrical connecting wall, said connecting wall being configured and sized for being slidably and substantially fittingly insertable over a corresponding longitudinal section of said tree trunk; said connecting component also including a connecting flange extending outwardly and substantially radially from said connecting wall substantially adjacent a lower peripheral edge thereof; said display component including a substantially cylindrical display wall, said display wall being configured and sized for being slidably and substantially fittingly insertable over at least a portion of said connecting wall, said display wall being also configured and sized for allowing a lower peripheral edge thereof to abuttingly rest on said connecting flange.

10. A combination as recited in claim 9 wherein said display component is also provided with a display arm extending outwardly and substantially radially from the outer surface of said display wall; said display arm being provided with a limb attachment means for attaching said tree limb and a lighting cable coupling means for electrically coupling and attaching said lighting cable.

11. A combination as recited in claim 10 wherein said tree limb is pivotable relative to said display component between a limb extended configuration and a limb retracted configuration wherein said tree limb forms an angle having respectively a larger and a smaller value relative to said trunk longitudinal axis; said limb attachment means including a substantially cylindrical limb base attached to a proximal end of said tree limb; said limb attachment means also including a limb receiving recess formed in said display arm, said limb receiving recess defining a base receiving section configured and sized for substantially fittingly and pivotally receiving said limb base and a limb abutment section extending from said base receiving section for abuttingly limiting the pivotal movement of said limb between said limb extended and retracted configurations.

12. A combination as recited in claim 11 wherein said lighting cable coupling means includes a cable plug attached to a proximal end of said lighting cable, said cable plug having a plug body and a pair of plug prongs extending from said plug body, said plug prongs being electrically coupled to said lighting cable; said lighting cable coupling means also including a plug receiving recess formed is said display arm for receiving said plug body and a pair of prong sockets formed in said plug receiving recess for receiving said plug prongs and allowing electrical coupling between said plug prongs and said prong sockets, said prong sockets being electrically coupled to a corresponding pair of arm wires extending at least partially through said display arm.

13. A combination as recited in claim 11 wherein said lighting cable coupling means includes a pair of coupling strips extending substantially circumferentially from said limb base, said coupling strips being electrically coupled to a proximal end of said lighting cable; said lighting cable coupling means also including a pair of strip contacting components for contacting said coupling strips and allowing electrical coupling between said coupling strips and said strip contacting components, said strip contacting components protruding from a contacting component receiving recess formed in said display arm; said strip contacting components being electrically coupled to a corresponding pair of arm wires extending at least partially through said display arm.

14. A combination as recited in claim 9 wherein said connecting component-to-light coupling means includes a first and a second connecting component coupling ring, said connecting component first and second coupling rings being mounted on said connecting component and being electrically connectable to said electrical power source, said connecting component-to-light coupling means includes a first and a second display component coupling ring, said display component first and second coupling rings being mounted on said display component and connectable to said lighting cable, said first and second connecting component coupling rings and said first and second display component coupling rings being configured, positioned and sized for allowing electrical coupling respectively therebetween so as to allow electrical coupling of said lighting cable to said electrical power source when said display component is operatively mounted on said connecting component.

15. A combination as recited in claim 14 wherein said first and second connecting component coupling rings are positioned respectively on an outer surface of said connecting wall and on an upper surface of said connecting flange and wherein said first and second display component coupling rings are positioned respectively on an inner surface of said display wall and on a lower peripheral edge of said display wall.

16. A combination as recited in claim 14 comprising two connecting components and two corresponding display components, said electrical circuitry further including connecting component-to-connecting component electrical coupling means for electrically said two connecting components; said first and second connecting component coupling rings being electrically coupled to both to a connecting component male plug and a connecting component female plug respectively by a first ring-to-male plug cable and a second ring-to-male plug cable and by a first ring-to-female plug cable and a second ring-to-female plug cable; said connecting component-to-connecting component electrical coupling means including a connecting component-to-connecting component cable for electrically coupling the connecting component male and female plugs of adjacent connecting components.

17. A combination as recited in claim 1 wherein said display component has two tree limbs extending therefrom, said display component also having two corresponding lighting cables extending therefrom, each of said lighting cables being supportable by a corresponding tree limb and being provided with at least one decorative light; said lighting cables being electrically coupled in serie to said electrical power source.

18. A combination as recited in claim 1 wherein said display component has two tree limbs extending therefrom, said display component also having two corresponding lighting cables extending therefrom, each of said lighting cables being supportable by a corresponding tree limb and being provided with at least one decorative light; said lighting cables being electrically coupled in parallel to said electrical power source.

19. A combination artificial tree-lighting arrangement, said combination being connectable to an electrical power source for providing an illuminated decoration, said combination comprising:

a generally elongated tree trunk, said tree trunk defining a trunk longitudinal axis;

at least one connecting component, said connecting component being mountable on said tree trunk;

at least one display component mountable on said connecting component, said display component having at least one tree limb extending therefrom, said display component also having at least one lighting cable extending therefrom, said lighting cable being supportable by said tree limb and being provided with at least one decorative light;

an electrical circuitry connectable to said electrical power source, said electrical circuitry being attachable to said connecting component, said electrical circuitry including a connecting component-to-light coupling means for electrically coupling said connecting component to said decorative light, said connecting component-to-light coupling means allowing said display component to rotate relative to said connecting component about a rotation axis substantially parallel to said trunk longitudinal axis while maintaining the electrical coupling between said connecting component and said decorative light; said lighting cable being releasably attachable to said display component.

* * * * *